US008978305B2

(12) United States Patent
Morstatt et al.

(10) Patent No.: US 8,978,305 B2
(45) Date of Patent: Mar. 17, 2015

(54) APPARATUS AND METHOD FOR ELECTROMECHANICALLY RETRACTING A DOOR LATCH

(71) Applicant: Yale Security Inc., Monroe, NC (US)

(72) Inventors: Scott G. Morstatt, Maryville, TN (US); Jeffrey Sharps, Knoxville, TN (US); Anthony Benitez, Loudon, TN (US)

(73) Assignee: Yale Security Inc., Monroe, NC (US)

( * ) Notice: Subject to any disclaimer, the term of this patent is extended or adjusted under 35 U.S.C. 154(b) by 0 days.

(21) Appl. No.: 14/057,763

(22) Filed: Oct. 18, 2013

(65) Prior Publication Data

US 2014/0109479 A1 Apr. 24, 2014

Related U.S. Application Data

(60) Provisional application No. 61/716,274, filed on Oct. 19, 2012.

(51) Int. Cl.

| | |
|---|---|
| ***E05D 7/12*** | (2006.01) |
| ***E05B 65/10*** | (2006.01) |
| ***E05B 47/02*** | (2006.01) |
| *E05B 15/00* | (2006.01) |
| *E05B 47/00* | (2006.01) |

(52) U.S. Cl.

CPC ..... *E05B 65/1093* (2013.01); *E05B 47/026* (2013.01); *E05B 65/1053* (2013.01); *E05B 15/004* (2013.01); *E05B 47/0004* (2013.01); *E05B 2047/0059* (2013.01); *E05B 2047/0065* (2013.01); *E05B 2047/0094* (2013.01)

USPC ..... 49/394; 70/92; 292/92; 292/93; 292/201; 292/144; 292/216

(58) Field of Classification Search

USPC ..... 49/32, 394; 292/92, 93, 201, 144, 216, 292/DIG. 65; 70/92

See application file for complete search history.

(56) References Cited

U.S. PATENT DOCUMENTS

| | | | |
|---|---|---|---|
| 3,767,238 | A | 10/1973 | Zawadzki |
| 3,854,763 | A | 12/1974 | Zawadzki et al. |
| 4,384,738 | A | 5/1983 | Floyd |
| 4,801,163 | A | 1/1989 | Miller |
| 4,875,722 | A | 10/1989 | Miller et al. |

(Continued)

OTHER PUBLICATIONS

Adams Rite, Electrification Options and Accessories: Electrical Options for Exit Devices.

(Continued)

*Primary Examiner* — Jerry Redman

(74) *Attorney, Agent, or Firm* — Michael G. Johnston; Moore & Van Allen PLLC

(57) ABSTRACT

A retractor element includes a rigid slide connected between a latch bolt and a solenoid plunger for movement between a first position and a second position, the slide operably connected to plunger. A pivoting link defines a slot having an inner end portion extending transversely, the slot configured for pivoting the link when the slide moves between the first position and the second position of the slide. When the retracting mechanism is energized the plunger retracts causing movement of the slide to the second position of slide and the pin to enter the transverse end of the slot in the link. A bearing surface intersects the path of movement of the pin such that significantly less current is required for retaining the plunger in the retracted position than to retract the plunger for blocking the return of the latch bolt to the projected position.

19 Claims, 10 Drawing Sheets

(56) References Cited

U.S. PATENT DOCUMENTS

| | | | | |
|---|---|---|---|---|
| 4,976,476 | A | 12/1990 | Cross et al. | |
| 5,340,171 | A * | 8/1994 | Slaybuagh et al. | 292/21 |
| 5,474,348 | A | 12/1995 | Palmer et al. | |
| 6,009,732 | A * | 1/2000 | Haeck et al. | 70/92 |
| 6,116,661 | A | 9/2000 | Overbey et al. | |
| 6,189,939 | B1 | 2/2001 | Zehrung | |
| 6,205,825 | B1 * | 3/2001 | Haeck et al. | 70/92 |
| 6,386,597 | B1 * | 5/2002 | Walsh, III | 292/92 |
| 6,394,508 | B1 | 5/2002 | Zehrung | |
| 6,565,130 | B1 * | 5/2003 | Walsh, III | 292/92 |
| 7,055,871 | B2 | 6/2006 | Toledo et al. | |
| 7,469,942 | B2 * | 12/2008 | Whitaker et al. | 292/92 |
| 7,484,777 | B2 * | 2/2009 | Condo et al. | 292/92 |
| 7,503,597 | B2 | 3/2009 | Cohrs, Jr. et al. | |
| 7,536,885 | B1 | 5/2009 | Ross et al. | |
| 7,712,800 | B2 * | 5/2010 | Peng | 292/92 |
| 7,832,778 | B2 * | 11/2010 | Whitaker et al. | 292/92 |
| 7,862,091 | B2 * | 1/2011 | Escobar | 292/93 |
| 7,883,123 | B2 * | 2/2011 | Condo et al. | 292/92 |
| 8,495,836 | B2 * | 7/2013 | Lowder et al. | 49/394 |
| 2001/0005996 | A1 * | 7/2001 | Haeck et al. | 70/92 |
| 2002/0105191 | A1 * | 8/2002 | Surko, Jr. | 292/92 |
| 2005/0104381 | A1 * | 5/2005 | Whitaker et al. | 292/190 |
| 2006/0082162 | A1 * | 4/2006 | Escobar | 292/144 |
| 2008/0012350 | A1 * | 1/2008 | Condo et al. | 292/92 |
| 2008/0169655 | A1 * | 7/2008 | Gomez Gonzalez | 292/81 |
| 2009/0079204 | A1 * | 3/2009 | Whitaker et al. | 292/93 |
| 2009/0127869 | A1 * | 5/2009 | Condo et al. | 292/92 |
| 2010/0045053 | A1 * | 2/2010 | Dye et al. | 292/201 |
| 2010/0123323 | A1 * | 5/2010 | Geringer et al. | 292/164 |
| 2012/0133156 | A1 * | 5/2012 | Tillman et al. | 292/80 |

OTHER PUBLICATIONS

Yale Security Inc., International Application No. PCT/US2013/065669, International Search Report and Written Opinion, Feb. 14, 2014.

* cited by examiner

APPARATUS AND METHOD FOR ELECTROMECHANICALLY RETRACTING A DOOR LATCH

BACKGROUND

This application is related to U.S. provisional application No. 61/716,274, filed Oct. 19, 2012, entitled "APPARATUS FOR ELECTRICALLY RETRACTING A DOOR LATCH", naming Scott G. Morstatt, Jeffrey Sharps, and Anthony Benitez as the inventors. The contents of the provisional application are incorporated herein by reference in their entirety, and the benefit of the filing date of the provisional application is hereby claimed for all purposes that are legally served by such claim for the benefit of the filing date.

An apparatus is shown and described for electromechanical retraction of a door latch, including a dogging mechanism for holding the door latch in a retracted position and, more particularly, an apparatus for electromechanical door latch retraction and dogging which uses less power in the retracted and dogged state.

An exit device for a door generally includes a frame or housing secured across a door face and substantially spanning the width of the door. A touch bar, sometimes referred to as a "panic bar" or "push bar", is movably mounted to the frame. The touch bar is mechanically linked to a latch mechanism, including a door latch which is movably mounted on the frame adjacent to a free edge of the door. Depressing the touch bar in the frame and toward the door translates the mechanical linkage for actuating the latch mechanism in order to retract the door latch, which may be a rim latch with a latch bolt or vertical rods with ceiling and floor latches, so that the door can be opened.

It is known to fix or "dog" an exit device in order to maintain an unlocked condition. Typically, dogging requires that the touch bar be held in its depressed or actuated position and prevented from returning to its outward position such that the door latch remains in a retracted position. Dogging mechanisms are useful to facilitate entry and exit through the door during heavy usage times, such as at the start and end of a work shift and during emergencies, or when there is no latch actuator on the outside of the door to gain entry.

Manually or electrically operated dogging mechanisms are available for holding the touch bar in the depressed position or keeping the latch bolt retracted. For example, an electrically operated exit device may use a solenoid to dog the touch bar in its depressed position. The plunger of the solenoid may also be operatively coupled to the door latch for moving the latch bolt from its projected position to its retracted position and holding the latch bolt in its retracted position, whether or not the touch bar is electrically dogged. In either type of exit device, the solenoid must provide a substantial force to retract and hold the touch bar or door latch, especially to overcome initial friction. Consequently, a relatively high operating current is required to reliably retract the touch bar or the latch bolt, and to dog the touch bar or latch bolt in the retracted position.

For the foregoing reasons, there is a need for a new apparatus for use in an electromechanically operated exit device, including a solenoid for retracting a latch bolt, and which will require significantly less power for maintaining the solenoid plunger, and therefore the latch bolt, in the retracted position until the latch bolt is released. The new apparatus should include a dogging assembly for an exit device for holding the latch bolt in the retracted position.

SUMMARY

An exit device is described for use with a door pivotally mounted along one edge for movement about an axis. The exit device comprises a housing having a longitudinal axis, the housing adapted to be secured to a surface of the door. A latch mechanism includes a latch bolt disposed at one end of the housing adapted to be adjacent an edge of the door, the latch bolt movable relative to the housing between a projected position extending outwardly of the housing for latching the door in a closed position and a retracted position where the latch bolt is inside the housing for allowing the door to be opened. An actuator is movably mounted on the housing for movement relative to the housing between a first position and a second position, the actuator operably connected to the latch mechanism for moving the latch bolt to the retracted position when the actuator is moved to the second position in response to application of manual force on the actuator. An electrically energizable retracting mechanism is mounted to the housing, the retracting mechanism including a reciprocating plunger and selectively connected to a source of electrical power for moving the plunger from an extended position to a retracted position when the retracting mechanism is energized and for releasing the plunger from the retracted position when the retracting mechanism is de-energized. A retractor element disposed in the housing includes a rigid slide connected between the latch bolt and the solenoid plunger for movement along the longitudinal axis of the housing between a first position and a second position, the slide including a pin extending transversely of the direction of movement of the slide and operably connected to plunger, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger. A controller adapted to control the operation of the retracting mechanism, wherein when the retracting mechanism is energized the plunger moves to the second position of the plunger causing movement of the slide to the second position of slide and the pin to enter the transverse end of the slot in the pivoting link against the bias of the spring where a bearing surface defining at least a portion of the end of the slot intersects the path of movement of the pin such that significantly less current is required for retaining the plunger armature in the retracted position than to retract the plunger for blocking the return of the latch bolt to the projected position. Upon de-energizing the retracting mechanism allows the pivoting link to move to the first position under force of the spring and the plunger to move to the extended position such that the latch moves to the projected position.

An apparatus for use in an exit device for holding a latch mechanism including a latch bolt in the retracted position comprises a retractor element disposed in the housing. The retractor element includes a rigid slide connected between the latch bolt and the solenoid plunger for movement along the longitudinal axis of the housing between a first position and a second position, the slide including a pin extending transversely of the direction of movement of the slide and operably connected to plunger, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger. A controller is adapted to control the operation of the retracting mechanism, wherein when the retracting mechanism is energized the plunger moves to the second position of the plunger causing movement of the slide to the second position of slide and the pin to enter the transverse end of the slot in the pivoting link against the bias of the spring where a bearing surface defining at least a portion of the end of the slot intersects the path of movement of the pin such that significantly less current is required for retaining the plunger armature in the retracted position than to retract the plunger for blocking the return of the latch bolt to the projected position. Upon de-energizing the retracting mechanism allows the pivoting link to move to the first position under force of the spring and the plunger to move to the extended position such that the latch moves to the projected position.

Also described, in combination, is a door frame, a door hinged along one edge to the door frame, and an exit device. The exit device comprises a housing having a longitudinal axis, the housing adapted to be secured to a surface of the door. A latch mechanism includes a latch bolt disposed at one end of the housing adapted to be adjacent an edge of the door, the latch bolt movable relative to the housing between a projected position extending outwardly of the housing for latching the door in a closed position and a retracted position where the latch bolt is inside the housing for allowing the door to be opened. An actuator is movably mounted on the housing for movement relative to the housing between a first position and a second position, the actuator operably connected to the latch mechanism for moving the latch bolt to the retracted position when the actuator is moved to the second position in response to application of manual force on the actuator. An electrically energizable retracting mechanism is mounted to the housing, the retracting mechanism including a reciprocating plunger and selectively connected to a source of electrical power for moving the plunger from an extended position to a retracted position when the retracting mechanism is energized and for releasing the plunger from the retracted position when the retracting mechanism is de-energized. A retractor element disposed in the housing includes a rigid slide connected between the latch bolt and the solenoid plunger for movement along the longitudinal axis of the housing between a first position and a second position, the slide including a pin extending transversely of the direction of movement of the slide and operably connected to plunger, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger. A controller adapted to control the operation of the retracting mechanism, wherein when the retracting mechanism is energized the plunger moves to the second position of the plunger causing movement of the slide to the second position of slide and the pin to enter the transverse end of the slot in the pivoting link against the bias of the spring where a bearing surface defining at least a portion of the end of the slot intersects the path of movement of the pin such that significantly less current is required for retaining the plunger armature in the retracted position than to retract the plunger for blocking the return of the latch bolt to the projected position. Upon de-energizing the retracting mechanism allows the pivoting link to move to the first position under force of the spring and the plunger to move to the extended position such that the latch moves to the projected position.

BRIEF DESCRIPTION OF THE DRAWINGS

For a more complete understanding of the present invention, reference should now be had to the embodiments shown in the accompanying drawings and described below. In the drawings.

DESCRIPTION

An apparatus for electromechanically retracting a door latch is shown and described in combination with an exit device including a door latch. The electromechanical latch actuator includes a solenoid for retracting the door latch and holding the door latch in the retracted position. The electromechanical latch actuator is described herein in combination with portions of an exit device, which is generally described in the U.S. Pat. No. 7,469,942, the contents of which are hereby incorporated by reference. It is understood that the electromechanical latch actuator may be used in any conventional touch bar exit device such as, for example, the exit devices described by U.S. Pat. Nos. 4,167,280; 4,796,931; 5,605,362; 5,823,582 and 6,104,594, the contents of all of which are hereby incorporated by reference in their entirety. Accordingly, detailed explanations of the functioning of the entire exit device components are deemed unnecessary for understanding the present invention by one of ordinary skill in the art. However, it should be understood that the present invention has other applications and is not limited to combination with the exit devices disclosed in the patents listed herein.

Certain terminology is used herein for convenience only and is not to be taken as a limitation on the invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise.

Figure 1:
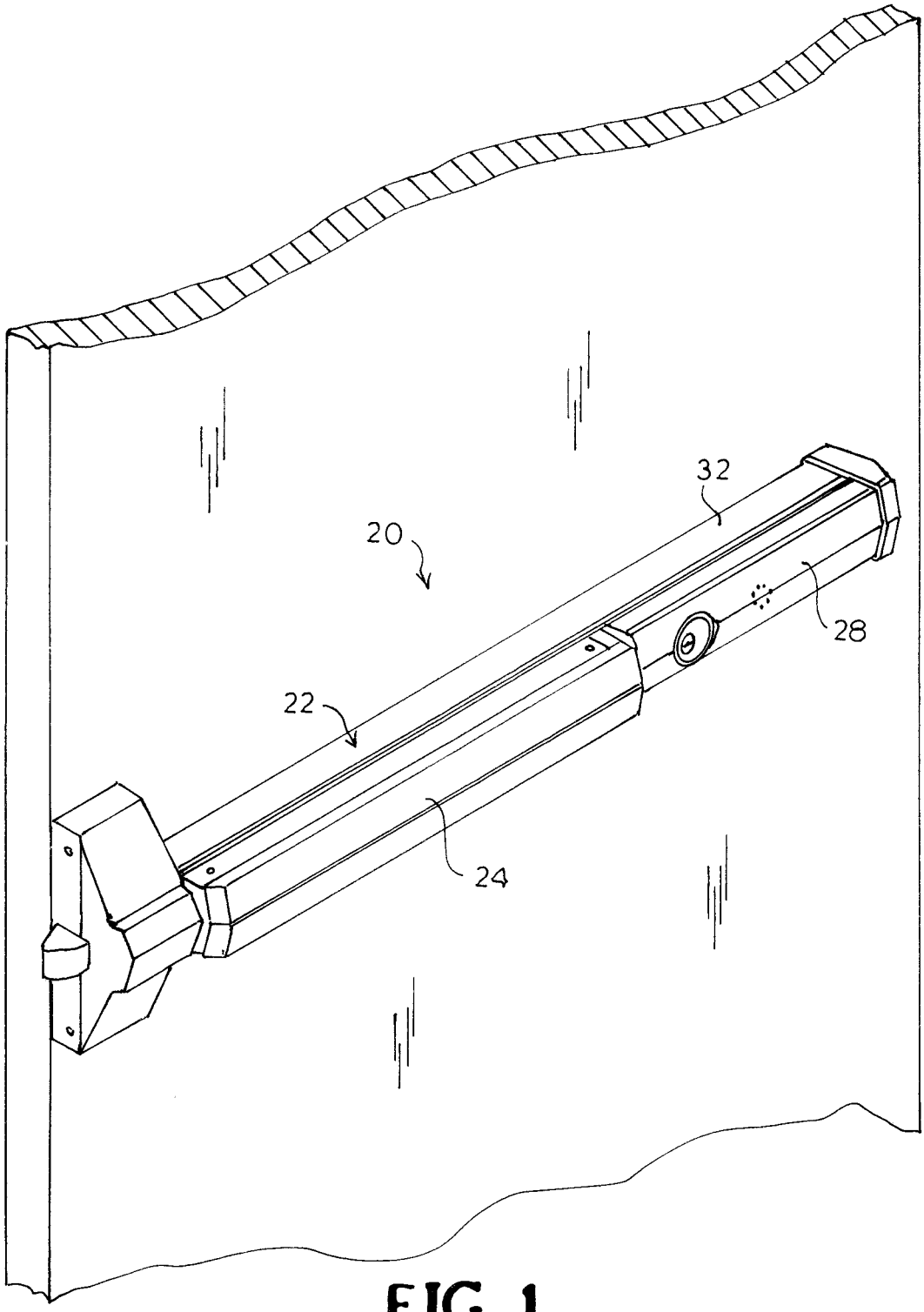
FIG. 1 is a perspective view of an embodiment of an exit device on a door.

Referring now to the drawings, wherein like reference numerals designate corresponding or similar elements throughout several views, FIG. 1 shows an exit device incorporating an embodiment of an electromechanical latch actuator and generally designated by the reference numeral 20. The exit device 20 includes an elongated housing 22 that is mounted at a horizontal position across the interior surface of an outwardly opening door 23 to be secured. The housing 22 comprises a touch bar 24, a latch housing 26 at one end and a cover plate 28 having an end cap 30 at the other end. The touch bar 24 longitudinally spans a substantial portion of the housing 22 and defines a face for receiving a pushing force exerted toward the door by a person attempting to egress through the door. A U-shaped shield 32 comprising side rails 36 and a base plate 38 fits around and slides over a frame 34 (not seen in FIG. 1). The shield 32 is adapted to be mounted flat against the surface of the door 23. The base plate 38 is generally channel-shaped and is secured to the door by screws or other fasteners (not shown). For purposes of the description herein, the base plate defines a central longitudinal axis which extends parallel to the surface of the door and a transverse axis which extends perpendicularly to the longitudinal axis of the base plate 38.

Figure 3:
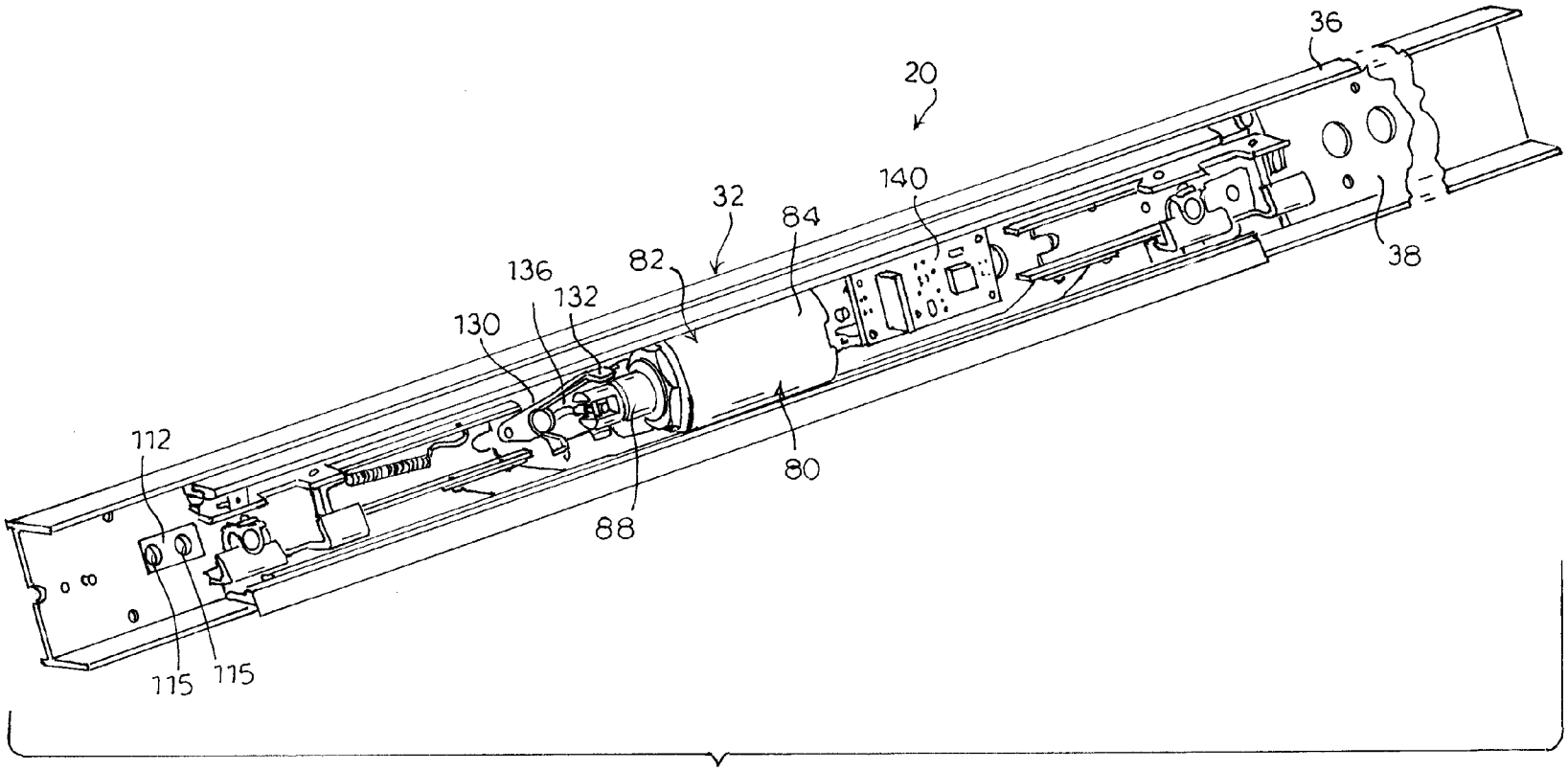
FIG. 3 is a perspective view of a portion of the exit device as shown in FIG. 1 with a cover plate and shield removed and showing an embodiment of an apparatus for electromechanically retracting the door latch.
Figure 4:
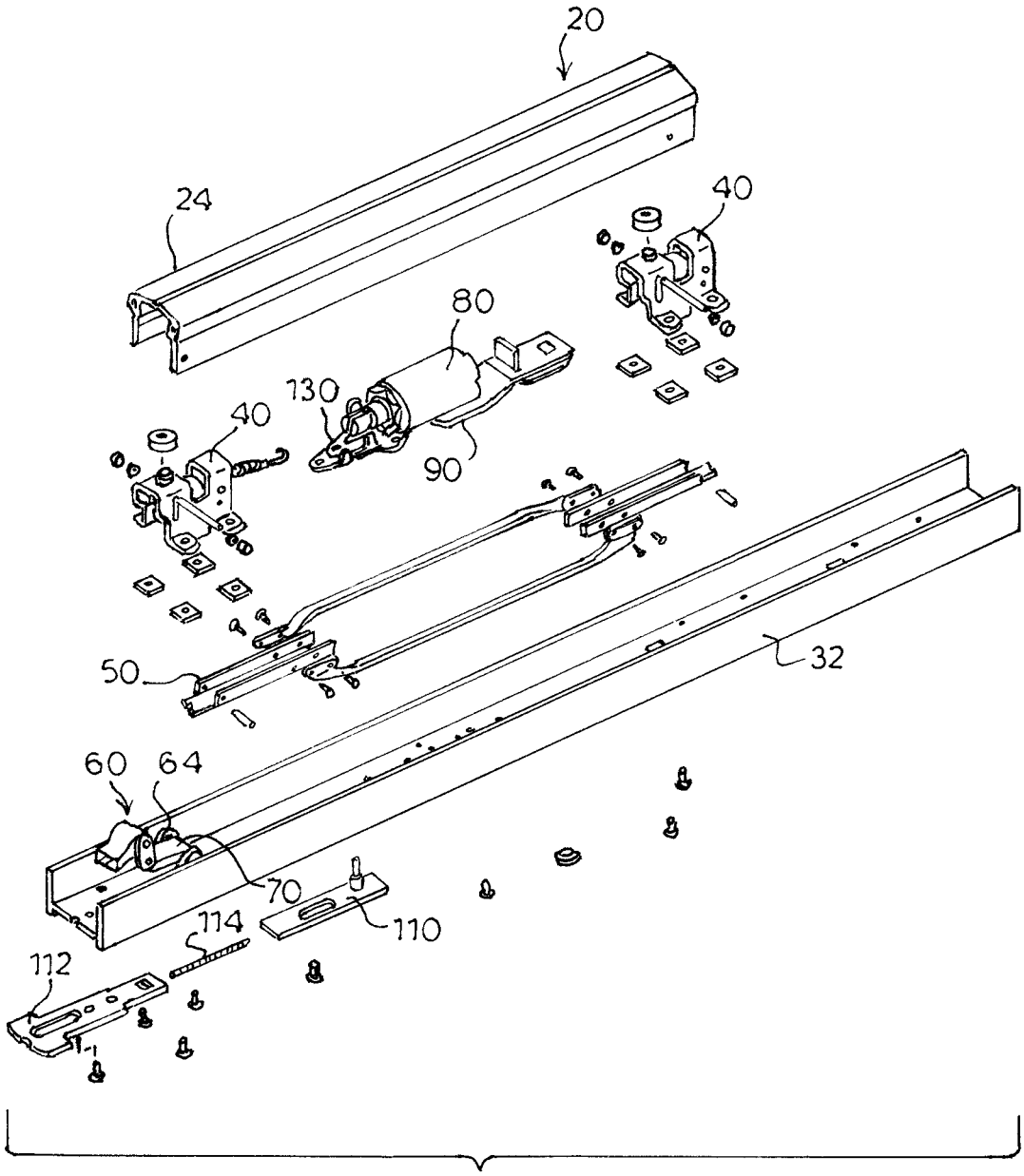
FIG. 4 is an exploded perspective view of the exit device and door latch retracting apparatus as shown in FIG. 3.

FIGS. 3 and 4 show the exit device 20 with the cover plate 28 and shield 32 removed. A pair of spaced touch bar mounts 40 is seen secured to the base plate 38. The sidewalls 42 of the touch bar mounts 40 extend transversely from the base plate 38 and are slotted in an arc 44. A pair of pins 46 is rigidly mounted between the side walls of the touch bar 24 and pass through the slots 44 in the touch bar mounts 40. An L-shaped lever arm 48 is pivotally attached at its vertex to each of the touch bar mounts 40. A first leg of each lever arm 48 is connected at its distal end to the touch bar pin 46 that travels in the associated slot 44 for drivingly connecting the touch bar 24 to the lever arms 48.

The distal end of the second leg of each lever arm 48 is pivotally connected to an elongated slide assembly 50. The slide assembly 50 is a substantially flat bracket piece disposed adjacent the base plate 38. The slide 50 assembly is attached at each end to the second legs of the lever arms 48. The slide assembly 50 is movably mounted relative to the baseplate 38 so that movement of the touch bar 24 transversely inwardly toward the door will move the slide assembly 50 longitudinally of the baseplate 38.

Figure 2:
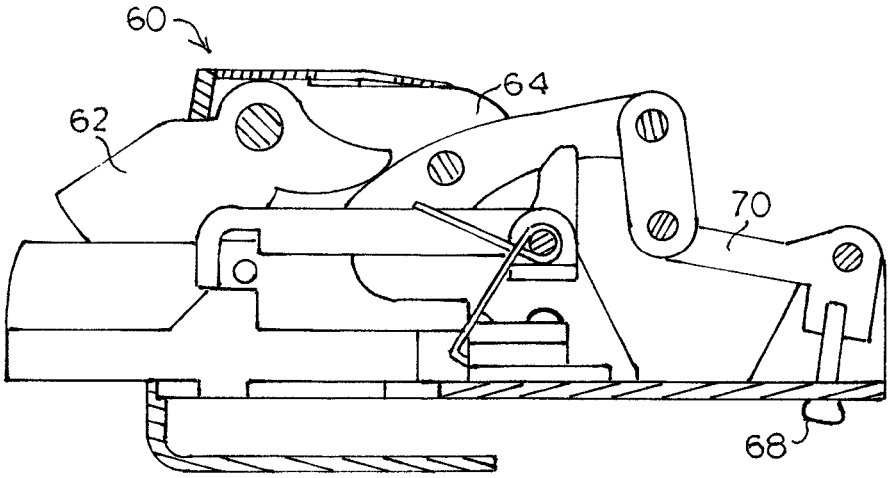
FIG. 2 is a top plan view of an embodiment of a latch assembly including a door latch for use in the exit device as shown in FIG. 1.

A latch mechanism 60, shown in the FIG. 2, is secured adjacent the outer end of the base plate 38. The latch mechanism 60 includes a latch bolt 62 mounted in a latch housing 64 for reciprocal axial movement from a first, projected position beyond the latch housing 64 to a second, retracted position. The latch bolt 62 depicted in FIG. 2, along with the latch mechanism 60, moves linearly and is described in the '362 patent cited above. A spring 66 acts to bias the latch bolt 62 toward its projected position. It is understood that the latch bolt may be mounted for pivotal movement between projected and retracted positions, as in a latch mechanism according to a conventional rim device, a mortise device, or floor and ceiling latches as in a concealed vertical rod latch assembly, or a combination of the above. Moreover, in each of the embodiments described herein, the exit device depicted is constructed and functions like those well known in the art and as disclosed in the '362 and '931 patents.

Retraction of the latch bolt 62 from inside of the door is achieved by pushing the touch bar 24 inwardly toward the door as is conventional. Transverse movement of the touch bar 24 pivots the touch bar mounts 40 through an arc motion, which is translated into a generally longitudinal motion at the bottom of the pivoting lever arm legs 48. The connection between the lever arms 48 and slide assembly 50 causes the slide assembly 50 to reciprocate linearly inwardly in the frame toward the hinged edge of the door. This movement also causes inward movement of a latch slide, which swings a pin in a latch actuator tongue inward to actuate the latch mechanism to retract the latch bolt 62 allowing the door to be opened. When the touch bar 24 is subsequently released from the manual pressure, the touch bar returns to the position shown in FIG. 1 due to the force of return springs connected between the touch bar mounts 40 and the base plate 38. Many different known mechanisms can be used to cause the latch bolt 62 to retract as the touch bar 24 is depressed. It is understood that each of these known mechanisms can be utilized in different embodiments of exit device 20 as described herein.

Lock trim (not shown), such as a handle and a rim cylinder, may be installed on the opposite side of the door and operatively connected with the latch mechanism so that the latch mechanism can be operated from the opposite side of the door. The connection between the outside cylinder and the projection is described in the '931 patent cited above.

Figure 5:
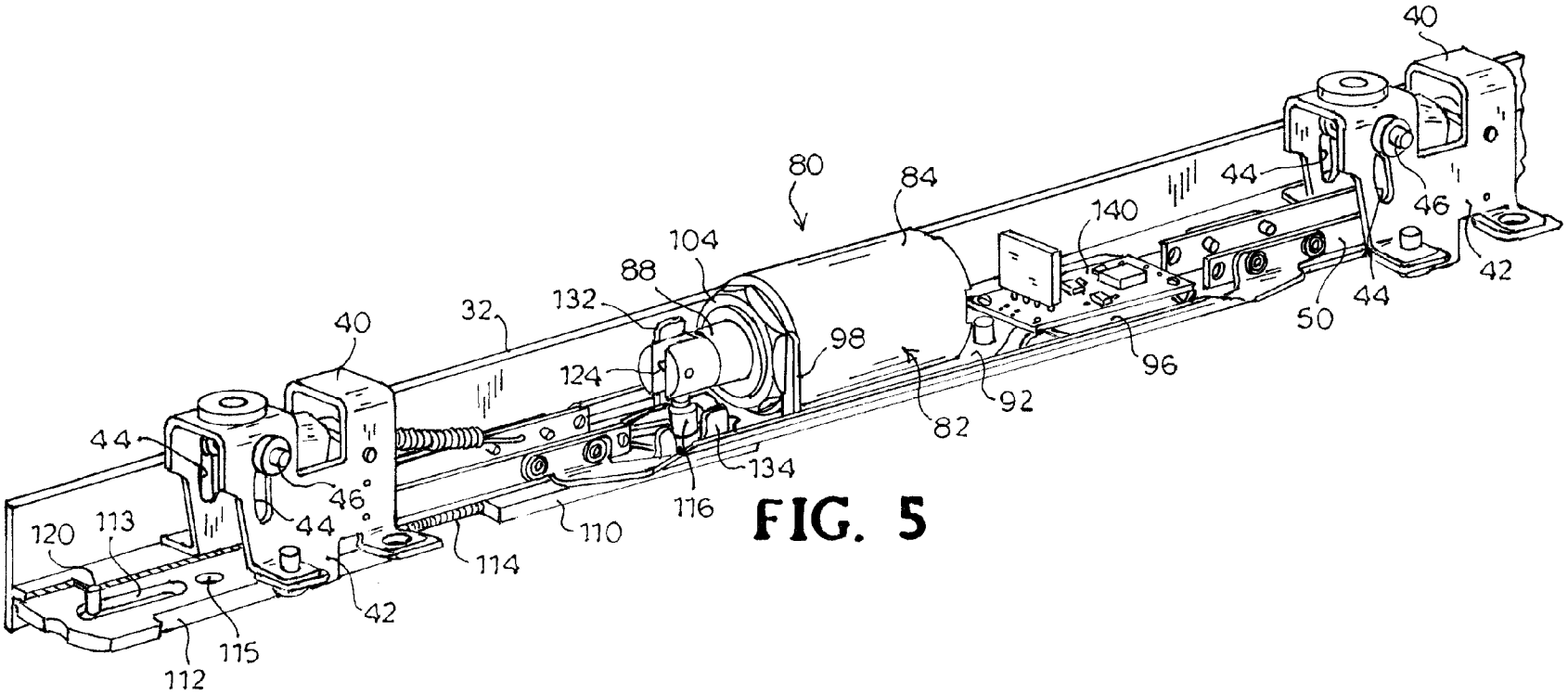
FIG. 5 is a perspective view of a portion of the exit device partially cut-away and the door latch retracting apparatus as shown in FIG. 3.
Figure 6:
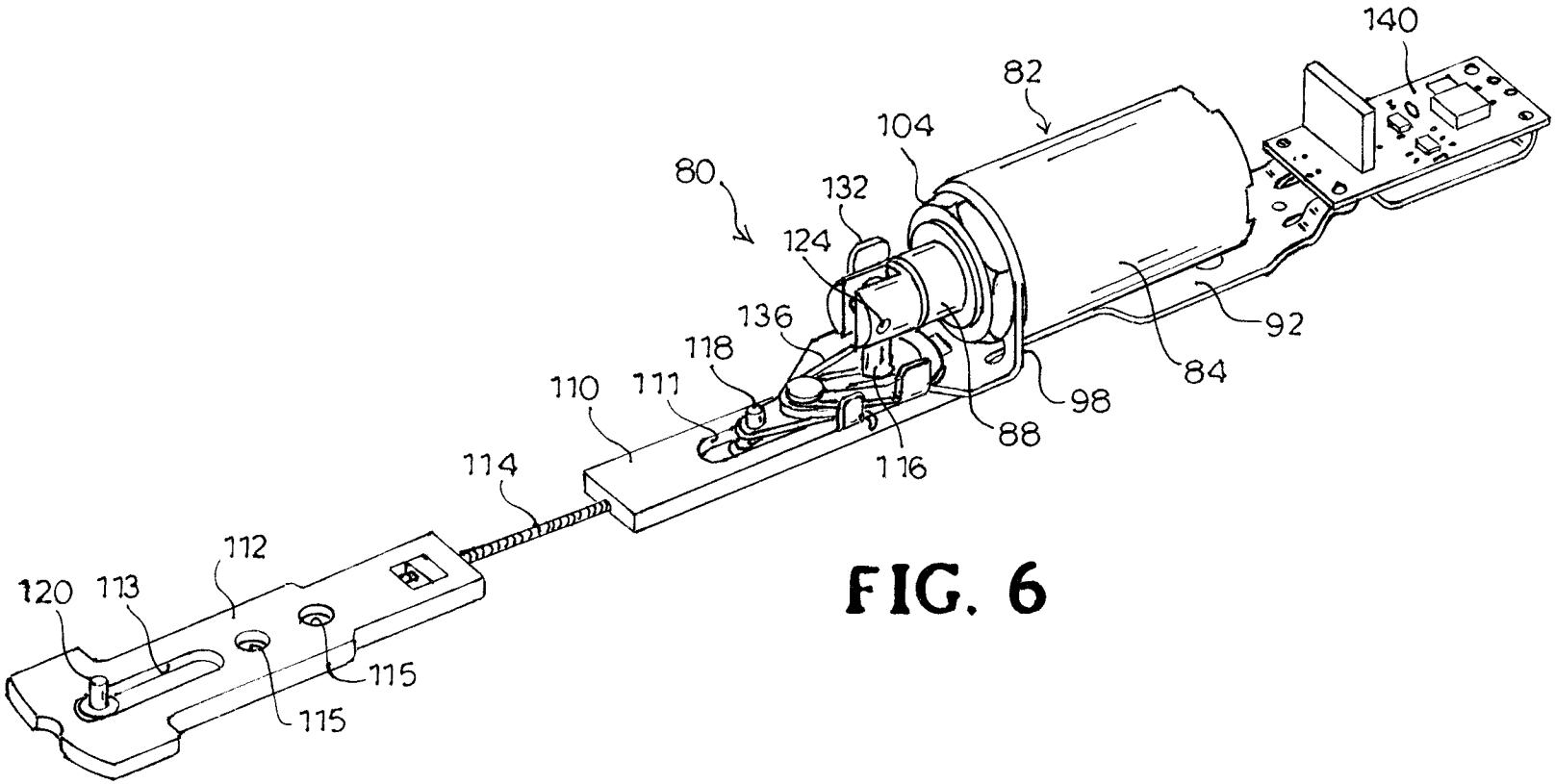
FIG. 6 is a perspective view of the latch retracting apparatus as shown in FIG. 3.
Figure 7:
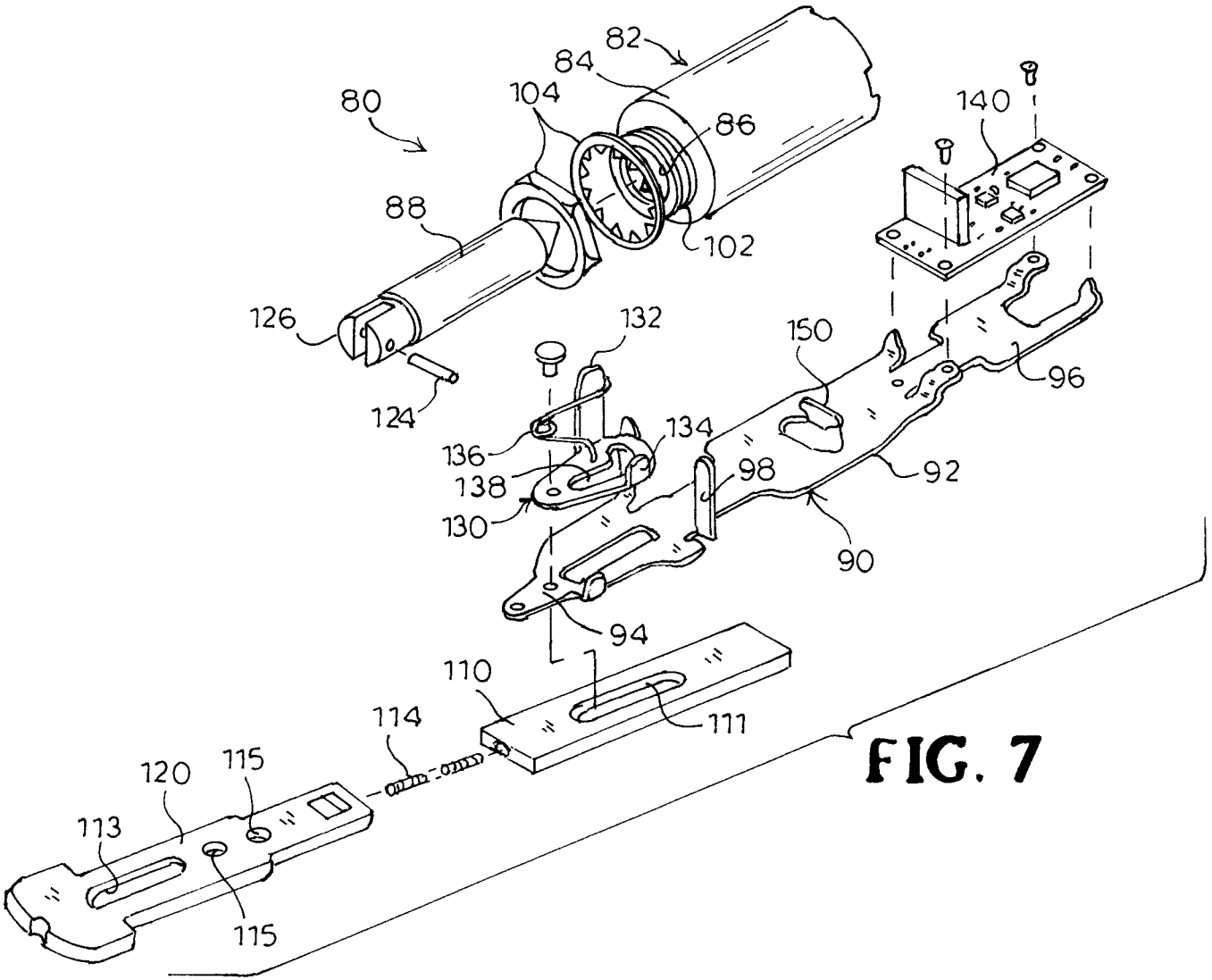
FIG. 7 is an exploded perspective view of the latch retracting apparatus as shown in FIG. 6.

Referring to FIGS. 3-5, an electromechanical latch actuator is shown for retracting and holding the latch bolt 62 in the retracted position and is generally designated at 80. As best seen in FIGS. 6 and 7, the actuator assembly 80 comprises a solenoid assembly 82, including a solenoid body 84 having an electrically actuated magnetic coil. The solenoid body 84 defines an axial bore 86 for slidably receiving a cylindrical ferrous metal plunger 88. The plunger 88 is rectilinearly moveable in the bore 86 relative to the solenoid body 84 in the direction of its axis between a first extended position and a second retracted position. A linkage assembly 90 operatively connects the movable plunger 88 and the latch assembly 60 for manipulating the latch bolt 62. The extended position of the plunger 88 corresponds to the projected position of the latch bolt 62 and the retracted position of the plunger 88 corresponds to the retracted position of the latch bolt 62.

The solenoid assembly 82 is a conventional, solenoid of the type which requires more current for retracting the plunger against a load than to hold the plunger in the retracted position against the urging of the load. The solenoid body 84 is attached to a substantially flat bracket 92 having a front portion 94 and a rear portion 96 and attached to the base plate 38. The front portion 94 of the bracket 92 includes a pair of opposed legs 98 extending transversely to the longitudinal axis of the bracket 92. A T-shaped flange 100 extends transversely from intermediate the bracket 92. When assembled, a central, cylindrical threaded shank 102 extending forwardly from a proximal end of the solenoid body 84 is received between the legs 98 of the bracket 92. The flange 100 fits in a corresponding slot in the solenoid body 84. A hex nut 104 is threaded onto the shank 102 and tightened for pinning the legs 98 against the end of the solenoid body 84 such that the solenoid is fixedly attached to the bracket 92.

The linkage assembly 90 comprises a bracket slide 110, a latch slide 112 and a connecting rod 114 fastened between the bracket slide 110 and the latch slide 112. The bracket slide 110 is a planar rectangular member defining a longitudinal slot 111 intermediate along its length. A link pin 116 extends perpendicularly from the upper surface of the bracket slide 110 adjacent an inner end. The bracket slide 110 is slidingly fixed to the bracket 92 by a guide pin 118 which passes through the slot 111 and into a threaded opening in the outer end of the bracket 92. The bracket slide 110 is able to slide relative to the bracket 92 and guide pin 118 a distance equal to the length of the slot 111 for guided longitudinal motion of the bracket slide 110.

The latch slide 112 is an elongated planar T-shaped member defining a longitudinal slot 113 extending from adjacent an outer end. The latch slide 112 is secured to the base plate 38 by a guide pin 120 which passes through the slot 113 and into a threaded opening in the base plate 38. The latch slide 112 is able to slide relative to the base plate 38 and the guide pin 113 a distance equal to the length of the slot 113 for guided longitudinal motion of the latch slide 112.

The link pin 116 of the bracket slide 110 extends through a slot 122 defined by the outer end of the plunger 88 forming two transversely spaced arms 126. A transverse pin 124 through the arms 126 secures the link pin 116 in the slot 122 for coupling longitudinal motion of the plunger 88 to the latch bolt 62. Inward longitudinal motion of the plunger 88 and the connected bracket slide 110 and latch slide 112 via the connecting rod 114 causes inward movement of the latch bolt 62.

Figure 8:
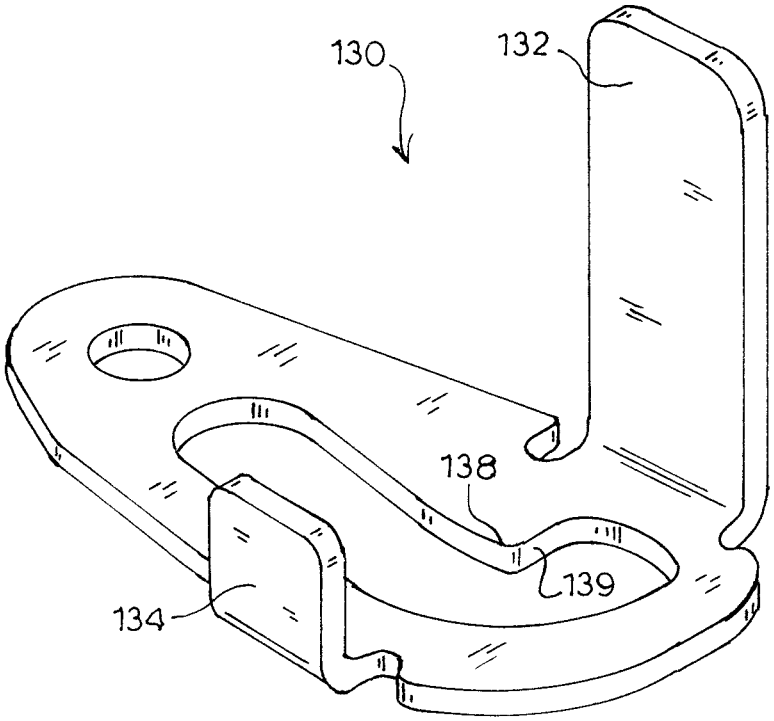
FIG. 8 is a perspective view of an embodiment of a dogging lever as shown in FIG. 7.

A dogging lever 130 (FIG. 8) is pivotally connected by a pin 132 to the outer end of the bracket 92 for pivotal movement about the pin. The dogging lever 130 is moveable between a first position out of alignment with the linear path of the plunger 88 and a second position substantially parallel to the path of the plunger 88. The dogging lever 130 has a leg 132 extending transversely from an edge of the dogging lever. The leg 132 is operably positioned adjacent the plunger 88 when the dogging lever 130 is in the second position. Two longitudinally spaced posts 134 extend transversely from an edge the dogging lever 130 opposite the leg 132. A torsion spring 136 biases the dogging lever 130 toward the first position. The dogging lever 130 defines a longitudinal J-shaped slot 138. The link pin 116 extends through the slot 138 for coupling longitudinal motion of the plunger 88 to pivotal movement of the dogging lever 130. The inner end of the slot 138 has a bearing surface 140 comprising a proximal edge of the slot 138. The bearing surface 140 intersects the path of the link pin 116 when the dogging lever 130 is in the second position. The dogging lever 130 thus cooperates with the link pin 116 to dog the plunger 88 in the retracted position.

The slot 111 in the bracket slide 110 provides a lost motion connection between the latch bolt 62 and linkage assembly 90 and the solenoid assembly 82. The lost motion connection allows manual depression of the touch bar 24 or contact by the latch bolt 62 with a strike (not shown) to move the latch bolt 62 inwardly to the retracted position causing longitudinal motion of the linkage assembly 90 without retraction of the plunger 88. Accordingly, the plunger 88 and the dogging lever 130 do not move from their first positions corresponding to the projected position of the latch bolt 62. Assuming the solenoid is de-energized, after return of the touch bar 24 to its normal, outward position, or cessation of contact between the latch bolt 62 and the strike, the spring-biased mechanism of the exit device 20 returns the latch bolt 62 to the projected position.

Power is supplied to the exit device from a remote power source over lines in a conventional manner. Wires to the power source extend into the door, for example, through electrical hinges in a conventional manner. A controller can also be utilized to control operation of the exit device, and in different embodiments the controller can be remote or local to the exit device. The controller can communicate with the exit device using many different "hard-wire" and wireless communication links. Energization of the solenoid may be a result of a control signal sent by the controller. Exit devices are readily adaptable for communication with a remote control or security system. The remote security system can be used to issue commands to the exit device to remotely unlatch the door, and also to maintain the door in an unlatched state. The computer may itself be coupled to a smoke detector or other alarm system to activate the latch actuator under emergency conditions. By integrating a building security system with exit devices including electromagnetic latch retractors, it is possible to effectuate the latching and unlatching of exit bars remotely and/or automatically.

In the embodiment shown, a PCB 140 provides a control circuit and is mounted to the bracket 92. The PCB 140 includes a connector through which power is supplied. In one embodiment, the connector includes a power connection and a control connection. Power is continuously supplied to the power connection and a switch is connected to the control connection. The switch may be a remotely actuated or part of an electrical control system, such as a fire control system or a security system.

Figure 10B:
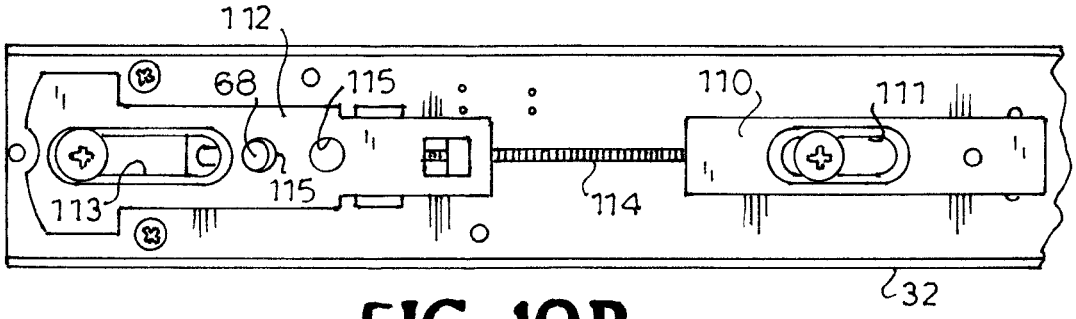
FIG. 10B is a bottom plan view of an embodiment of a slide assembly as shown in FIG. 9B in a second position.
Figure 10A:
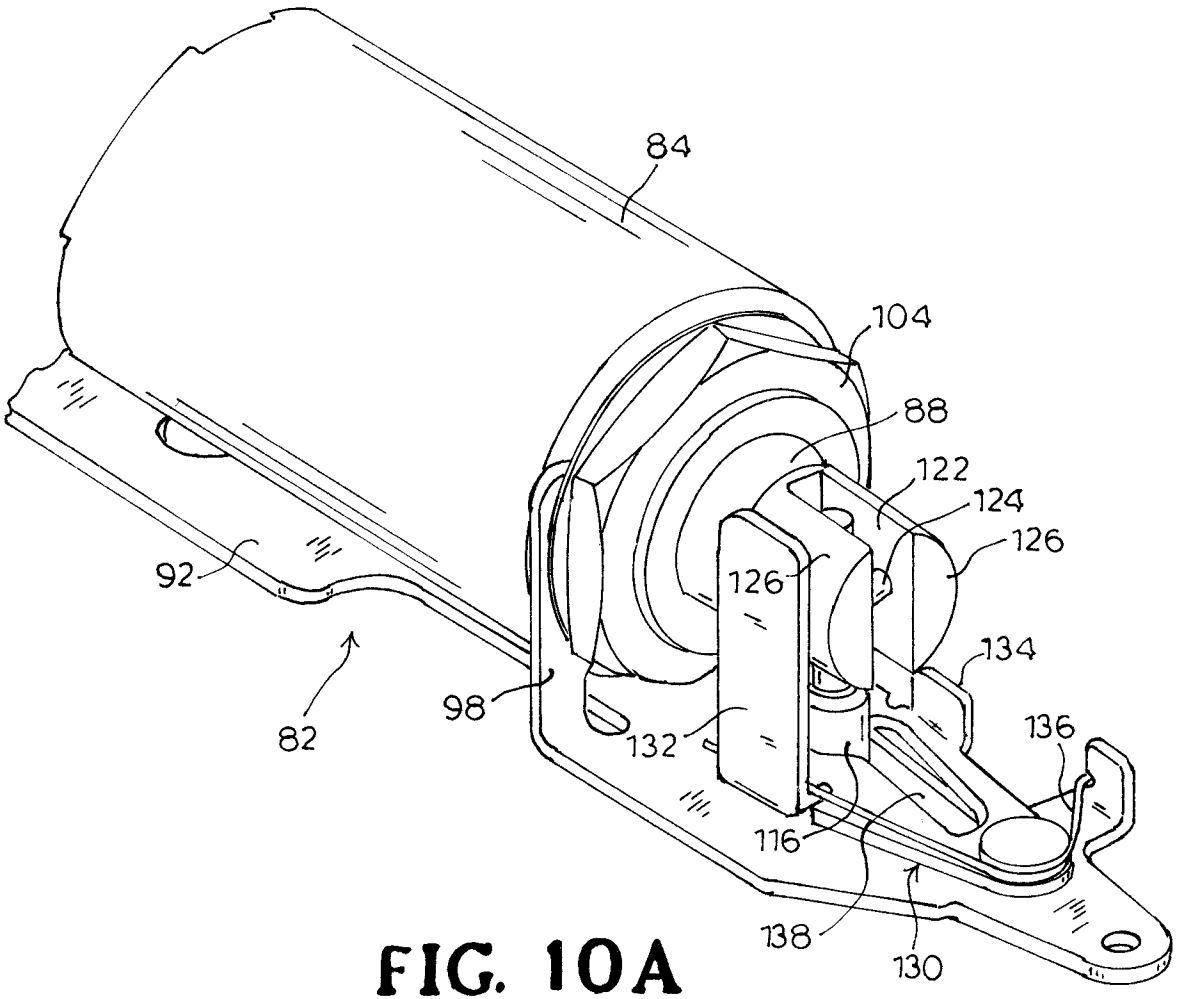
FIG. 10A is a partial perspective view of the solenoid assembly as shown in FIG. 9A in a second position.

In use, to dog the latch bolt 62 in the retracted position, the solenoid is energized so that the plunger 88 is moved to the retracted position into the solenoid body 84 by the magnetic field created, as shown in FIG. 10A. Due to the interconnection of the link pin 116 in the slot 122 of the plunger 88, the longitudinal motion of the plunger 88 causes the linkage assembly 90 to be drawn longitudinally inwardly which, in turn, moves the latch bolt 62 to its retracted position (FIG. 10B). The inward movement of the plunger 88 causes the link pin 116 to follow the path of the slot 138 causing pivotal motion of the dogging lever 130. As seen in FIG. 10A, the link pin 116 seats in the end of the slot 138 where the pin engages the bearing surface 139 to block the return of the plunger 88 to its projected position thereby holding the latch bolt 62 in a retracted position. The dogging lever 130 is held adjacent the front end of the plunger 88 by magnetic attraction to the plunger 88 against the force of the spring 136. In the "dogged" condition, the door is free to be pulled open from the outside or pushed open from the inside, with or without depressing the touch bar 24. The dogged condition may be utilized during heavy usage times of the day, for example, at the start and close of a work shift to minimize wear on the moving parts of the exit device 20, and also during emergency conditions.

Figure 9B:
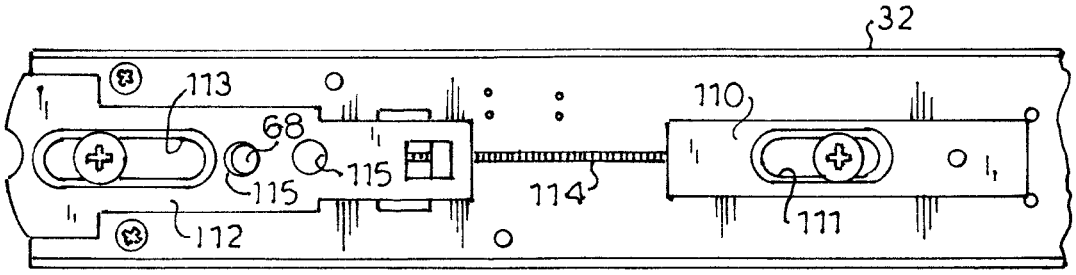
FIG. 9B is a bottom plan view of an embodiment of a slide assembly as shown in FIG. 6 in a first position.
Figure 9A:
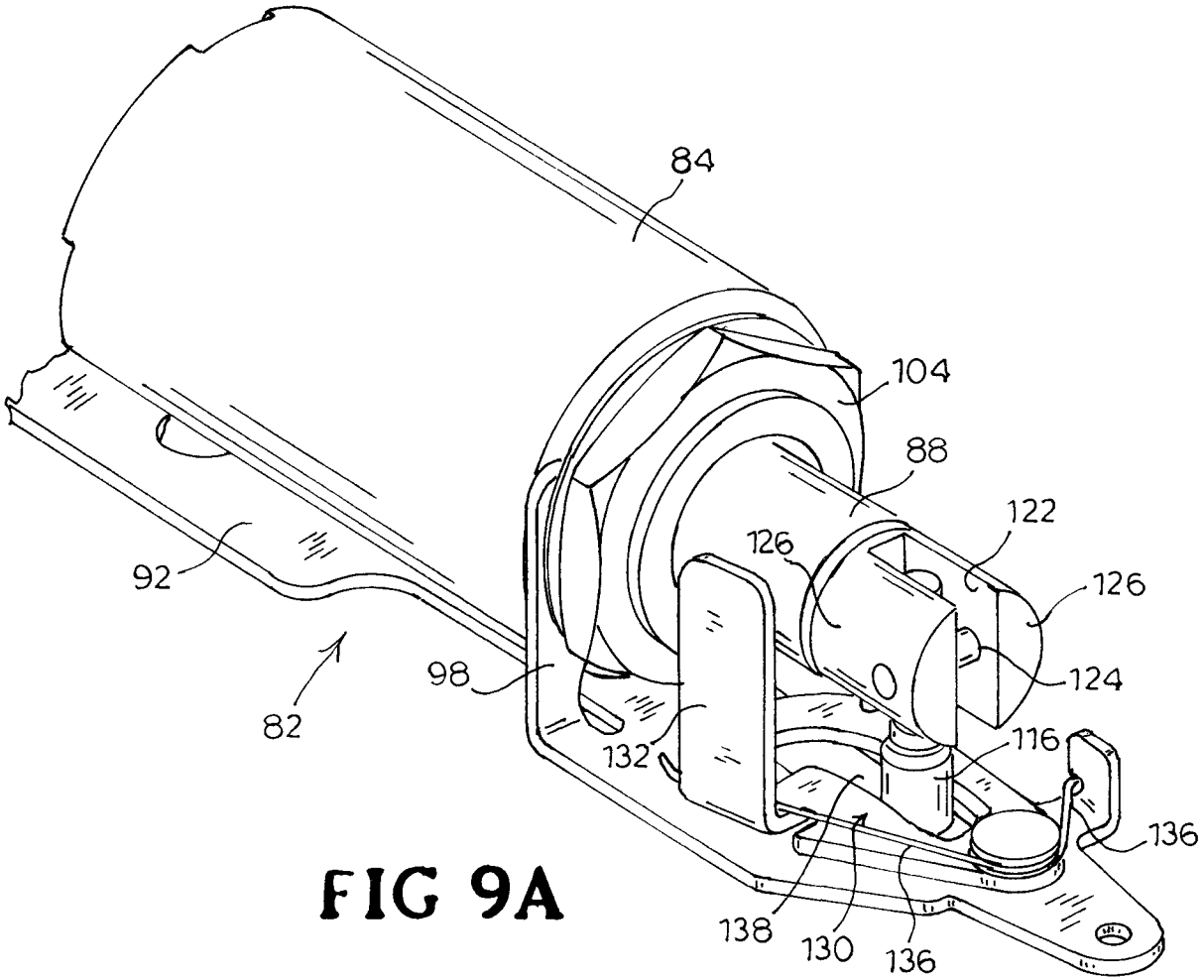
FIG. 9A is a partial perspective view of a solenoid assembly as shown in FIG. 6 in a first position.

The PCB includes two incoming power wires and two outgoing wires to the solenoid. When power is applied to the circuit board, the circuit board applies full power to the solenoid to retract the latch. After a predetermined time, the circuit switches over to a low PWM (pulse width modulation) for "dogging", which provides the magnetic field for holding the dogging lever 130 adjacent the solenoid and the plunger 88 in the retracted position. When the power to the solenoid is removed, either by the controller or by loss of power to the controller, the magnetic field collapses and the plunger 88 is released. The latch bolt 62 is biased to its projected position by the springs in the exit device 20, drawing the plunger 88 to its first position. Without the magnetic field, the dogging lever 130 is pivoted outwardly under the force of the spring 136 to the first position, clearing the path of the plunger 88 and the link pin 116 to move forwardly in the slot 138, as shown in FIG. 9A. The linkage assembly 90 returns to the first position under the influence of the biasing springs of the latch assembly 60 returning the latch bolt 62 to its extended position (FIG. 9B). It is understood that another spring configuration is suitable. The torsion spring 136 is fixed to the bracket 92 or a bracket fastener is suitable.

The apparatus for retracting a door latch has many advantages, including providing a low power, electrically operated exit device 20 and electromechanical latch actuator 80 for an exit device. The power required to drive the plunger 88 to retract the latch bolt 62 against the bias of the various springs and associated frictional interfaces is relatively large compared to the power required to generate a magnetic field to hold the dogging lever 130 in place for blocking the plunger 88 from returning to the projected position. Once the plunger moves to the retracted position and engages the bearing surface 139, the dogging lever 130 holds the plunger 88 in the retracted position and allows the power to be reduced while still keeping the exit device 20 in the unlatched condition. The only power needed is to energize the solenoid sufficiently to hold the dogging lever 130 against the force of the spring 136, which is much less than that consumed by the solenoid to retract the latch bolt 62. This arrangement realizes significant reduction in power consumption compared to a similar exit device 20. The apparatus can remain in the holding state with the solenoid energized, while drawing very little power and producing very little heat. In addition, the electromechanical latch actuator 80 as described herein may be retrofit into an existing exit device. Moreover, the electromechanical latch actuator is adaptable to exit devices having operating mechanisms other than touch bars.

Although the apparatus for electromechanically retracting a door latch has been shown and described in considerable detail with respect to only a few exemplary embodiments thereof, it should be understood by those skilled in the art that we do not intend to be limited to the embodiments since various modifications, omissions and additions may be made to the disclosed embodiments without materially departing from the novel teachings and advantages of the apparatus, particularly in light of the foregoing teachings. Accordingly, we intend to cover all such modifications, omission, additions and equivalents as may be included within the spirit and scope of the following claims. In the claims, means-plus-function clause(s) are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An exit device for use with a door pivotally mounted along one edge for movement about an axis, the exit device comprising:

a housing having a longitudinal axis, the housing adapted to be secured to a surface of the door;

a latch mechanism including a latch bolt disposed at one end of the housing adapted to be adjacent an edge of the door, the latch bolt movable relative to the housing between a projected position extending outwardly of the housing for latching the door in a closed position and a retracted position where the latch bolt is inside the housing for allowing the door to be opened;

an actuator movably mounted on the housing for movement relative to the housing between a first position and a second position, the actuator operably connected to the latch mechanism for moving the latch bolt to the retracted position when the actuator is moved to the second position in response to application of manual force on the actuator;

an electrically energizable retracting mechanism mounted to the housing, the retracting mechanism including a reciprocating plunger and connected to a source of electrical power for moving the plunger from an extended position to a retracted position when the retracting mechanism is energized and for releasing the plunger from the retracted position when the retracting mechanism is de-energized;

a retractor element disposed in the housing, the retractor element including a rigid slide connected between the latch bolt and the solenoid plunger for movement along the longitudinal axis of the housing between a first position and a second position, the slide including a pin extending transversely of the direction of movement of the slide and operably connected to the plunger for movement with the plunger along a path, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger; and a controller adapted to control the operation of the retracting mechanism, wherein when the retracting mechanism is energized the plunger moves to the second position of the plunger causing movement of the slide to the second position of slide and the pin to enter the transverse end of the slot in the pivoting link against the biasing of the spring where a bearing surface defining at least a portion of the end of the slot intersects the path of movement of the pin such that significantly less current is required for retaining the plunger armature in the retracted position than to retract the plunger for blocking the return of the latch bolt to the projected position, and wherein upon de-energizing the retracting mechanism allows the pivoting link to move to the first position under force of the spring and the plunger to move to the extended position such that the latch moves to the projected position.

2. An exit device as recited in claim 1, wherein the retracting mechanism comprises an electrically actuated magnetic coil through which electric current flows to retract the plunger and hold the plunger in the retracted position.

3. An exit device as recited in claim 2, wherein the pivoting link comprises a metal and is magnetically attracted to the retracting mechanism for holding the pivoting link in the second position.

4. An exit device as recited in claim 1, wherein the retracting mechanism comprises a solenoid.

5. An exit device as recited in claim 1, wherein the pivoting link pivots in a plane parallel to the direction of movement of the plunger.

6. An exit device as recited in claim 1, wherein the slide comprises a lost motion connection allowing movement of the latch bolt to the retracted position by the actuator without moving the slide.

7. An exit device as recited in claim 1, wherein the controller is configured to hold the latch bolt in the retracted position and release the latch bolt by de-energizing the retracting mechanism to return to the projected position.

8. An apparatus use in an exit device for holding a latch mechanism including a latch bolt in a retracted position on a door pivotally mounted along one edge for movement about an axis, the exit device including a housing adapted to be secured to a surface of a door, the latch bolt disposed at one end of the housing adjacent an edge of the door and movable relative to the housing between a projected position extending outwardly of the housing for latching the door in a closed position and the retracted position where the latch bolt is inside the housing for allowing the door to be opened, an actuator member mounted on the housing for movement relative to the housing from a first position to a second position, and an electrically energizable retracting mechanism mounted to the housing operative to hold the latch in the retracted position when energized, the apparatus for holding the latch bolt in the retracted position comprising:

a retractor element disposed in the housing, the retractor element including a rigid slide connected between the latch bolt and the solenoid plunger for movement along the longitudinal axis of the housing between a first position and a second position, the slide including a pin extending transversely of the direction of movement of the slide and operably connected to the plunger for movement with the plunger along a path, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger; and a controller adapted to control the operation of the retracting mechanism, wherein when the retracting mechanism is energized the plunger moves to the second position of the plunger causing movement of the slide to the second position of slide and the pin to enter the transverse end of the slot in the pivoting link against the biasing of the spring where a bearing surface defining at least a portion of the end of the slot intersects the path of movement of the pin such that significantly less current is required for retaining the plunger armature in the retracted position than to retract the plunger for blocking the return of the latch bolt to the projected position, and wherein upon de-energizing the retracting mechanism allows the pivoting link to move to the first position under force of the spring and the plunger to move to the extended position such that the latch moves to the projected position.

9. The apparatus for holding the latch bolt in the retracted position as recited in claim 8, wherein the retracting mechanism comprises an electrically actuated magnetic coil through which electric current flows to retract the plunger and hold the plunger in the retracted position.

10. The apparatus for holding the latch bolt in the retracted position as recited in claim 9, wherein the pivoting link comprises a metal and is magnetically attracted to the retracting mechanism for holding the pivoting link in the second position.

11. The apparatus for holding the latch bolt in the retracted position as recited in claim 8, wherein the retracting mechanism comprises a solenoid.

12. The apparatus for holding the latch bolt in the retracted position as recited in claim 8, wherein the pivoting link pivots in a plane parallel to the direction of movement of the plunger.

13. In combination, a door frame;

a door hinged along one edge to the door frame;

an exit device, comprising a housing having a longitudinal axis, the housing adapted to be secured to a surface of the door;

a latch mechanism including a latch bolt disposed at one end of the housing adapted to be adjacent an edge of the door, the latch bolt movable relative to the housing between a projected position extending outwardly of the housing for latching the door in a closed position and a retracted position where the latch bolt is inside the housing for allowing the door to be opened;

an actuator movably mounted on the housing for movement relative to the housing between a first position and a second position, the actuator operably connected to the latch mechanism for moving the latch bolt to the retracted position when the actuator is moved to the second position in response to application of manual force on the actuator;

an electrically energizable retracting mechanism mounted to the housing, the retracting mechanism including a reciprocating plunger and connected to a source of electrical power for moving the plunger from an extended position to a retracted position when the retracting mechanism is energized and for releasing the plunger from the retracted position when the retracting mechanism is de-energized;

a retractor element disposed in the housing, the retractor element including a rigid slide connected between the latch bolt and the solenoid plunger for movement along the longitudinal axis of the housing between a first position and a second position, the slide including a pin extending transversely of the direction of movement of the slide and operably connected to the plunger for movement with the plunger along a path, a pivoting link defining a slot having an inner end portion extending transversely to the longitudinal axis of the housing, the slot configured for receiving the pin for pivoting the link when the slide moves between the first position and the second position of the slide, and a spring for biasing the pivoting link away from the plunger; and a controller adapted to control the operation of the retracting mechanism, wherein when the retracting mechanism is energized the plunger moves to the second position of the plunger causing movement of the slide to the second position of slide and the pin to enter the transverse end of the slot in the pivoting link against the biasing of the spring where a bearing surface defining at least a portion of the end of the slot intersects the path of movement of the pin such that significantly less current is required for retaining the plunger armature in the retracted position than to retract the plunger for blocking the return of the latch bolt to the projected position, and wherein upon de-energizing the retracting mechanism allows the pivoting link to move to the first position under force of the spring and the plunger to move to the extended position such that the latch moves to the projected position.

14. The combination as recited in claim 13, wherein the retracting mechanism comprises an electrically actuated magnetic coil through which electric current flows to retract the plunger and hold the plunger in the retracted position.

15. The combination as recited in claim 14, wherein the pivoting link comprises a metal and is magnetically attracted to the retracting mechanism for holding the pivoting link in the second position.

16. The combination as recited in claim 13, wherein the retracting mechanism comprises a solenoid.

17. The combination as recited in claim 13, wherein the pivoting link pivots in a plane parallel to the direction of movement of the plunger.

18. The combination as recited in claim 13, wherein the slide comprises a lost motion connection allowing movement of the latch bolt to the retracted position by the actuator without moving the slide.

19. The combination as recited in claim 13, wherein the controller is configured to hold the latch bolt in the retracted position and release the latch bolt by de-energizing the retracting mechanism to return to the projected position.

* * * * *